US009090118B2

(12) United States Patent
Ikeda

(10) Patent No.: US 9,090,118 B2
(45) **Date of Patent: *Jul. 28, 2015**

(54) WATER PRESSURE TRANSFER METHOD, A TRANSFER FILM FOR WATER PRESSURE TRANSFER AND A WATER PRESSURE TRANSFER ARTICLE

(71) Applicant: TAICA CORPORATION, Minato-Ku, Tokyo (JP)

(72) Inventor: Wataru Ikeda, Shizuoka (JP)

(73) Assignee: TAICA CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/448,668

(22) Filed: Jul. 31, 2014

(65) Prior Publication Data

US 2015/0020703 A1 Jan. 22, 2015

Related U.S. Application Data

(62) Division of application No. 12/739,409, filed as application No. PCT/JP2008/069304 on Oct. 24, 2008, now Pat. No. 8,794,149.

(30) Foreign Application Priority Data

Oct. 25, 2007 (JP) ..... 2007-277501

(51) Int. Cl.
*B44C 1/175* (2006.01)
*B44C 1/16* (2006.01)

(52) U.S. Cl.
CPC . *B44C 1/175* (2013.01); *B44C 1/16* (2013.01); *B44C 1/1758* (2013.01); *Y10S 428/914* (2013.01)

(58) Field of Classification Search
CPC .... B44C 1/175; B44C 1/1752; B44C 1/1758; B44C 1/16; B44C 1/165; B44C 1/1733; B44F 9/02; B44F 7/00
USPC ..... 101/395, 4, 480, 483, 368; 428/195.1, 428/914; 156/230, 275.5; 427/430.1, 512
See application file for complete search history.

(56) References Cited

U.S. PATENT DOCUMENTS 8,178,187 B2 5/2012 Ikeda et al.
8,850,973 B2 * 10/2014 Ikeda et al. ..... 101/34

(Continued)

FOREIGN PATENT DOCUMENTS

JP 2007090836 A 4/2007
JP 2007098608 A 4/2007

(Continued)

OTHER PUBLICATIONS

International Search Report Dated Jan. 15, 2009 of PCT/JP2008/069304, Filed Oct. 24, 2008.

*Primary Examiner* — Blake A Tankersley
(74) *Attorney, Agent, or Firm* — Pearne & Gordon LLP

(57) ABSTRACT

A transfer film 316 which has a print pattern 340 comprising a first area 312A having an ink layer and a second area 312B having no ink layer and has no whole surface fixture layer formed thereon is prepared, an activating agent is applied onto the surface of the transfer film 316 to collect a surplus portion of the activating agent in a convex form in the second area by a repelling operation of the ink player 312I in the first area 312A and a collecting power of the activating agent 320, the convex collection portions 320C of the activating agent in the second area 312B have a concave-convex reversal made on the surface of the article 10 when the water pressure transfer is performed, and the convex collection portions of the activating agent are shrunk and protruded when the print layer is hardened whereby a three-dimensional unevenness is imparted onto the surface of the article.

6 Claims, 12 Drawing Sheets

(56) References Cited

U.S. PATENT DOCUMENTS

| | | | | |
|---|---|---|---|---|
| 2007/0087171 | A1* | 4/2007 | Hikasa et al. | 428/195.1 |
| 2007/0154685 | A1 | 7/2007 | Ikeda et al. | |
| 2008/0199664 | A1 | 8/2008 | Otaki et al. | |
| 2012/0263884 | A1 | 10/2012 | Otaki et al. | |

FOREIGN PATENT DOCUMENTS

| | | | |
|---|---|---|---|
| WO | 2005077676 | A1 | 8/2005 |
| WO | 2007023525 | A1 | 3/2007 |
| WO | 2007023577 | A1 | 3/2007 |

* cited by examiner (A)

(B)

(C)

(Size of Pattern of Circle Check Pattern)

| | Each Size of Circle Check Pattern |
|---|---|
| A Section | 580.28 micrometers |
| B Section | 873.88 micrometers |
| C Section | 684.56 micrometers |
| D Section | 1011.27 micrometers |

WATER PRESSURE TRANSFER METHOD, A TRANSFER FILM FOR WATER PRESSURE TRANSFER AND A WATER PRESSURE TRANSFER ARTICLE

TECHNICAL FIELD

This invention relates to a water pressure transfer method for transferring a print pattern of a transfer film on a surface of an article to form a print layer, a transfer film used for this water pressure transfer method and a water pressure transfer article manufactured by the water pressure transfer method, and more particularly a water pressure transfer method which can obtain a fine unevenness tactile feeling on a water pressure transfer article, a transfer film suitably used for this water pressure transfer method and a water pressure transfer article having a three-dimensional unevenness produced by this water pressure transfer method.

BACKGROUND OF THE INVENTION

Generally, the water pressure transfer method is a method for floating on a water surface in a transfer tub a transfer film formed by a predetermined print pattern of non-water solubility on a water-soluble film, making wet the water-soluble film of the transfer film with water, immersing an article (an object to be pattern-transferred) into the water in the transfer tub while contacting the transfer film, and transferring the print pattern of the transfer film on a surface of the article using the water pressure generated when the article is immersed into water to form a print layer.

In this water pressure transfer method, although the transfer film is obtained by printing the print pattern on the water-soluble film by gravure printing method etc., this transfer film is generally supplied to the water pressure transfer operation site by being shipped in a roll state after the ink of the print pattern is dried.

The water pressure transfer is performed for the purpose of decorating the surface of the article which is the object to be pattern-transferred. However, lately, a cubic effect is required to be imparted to the surface of the article together as well as the decoration of the article. To comply with this requirement, various unevenness imparting arts have been conventionally adopted.

One of the conventional unevenness imparting arts is a method of printing a pattern on a fine uneven surface of a decorative sheet having the fine uneven surface formed beforehand (see Patent Document 1). Since this conventional method must form the uneven surface beforehand on the decorative sheet by an embossment process or when the decorative sheet is formed, a separate processing operation before the decoration process is required or a peculiar forming mold is required. In addition thereto, voids tend to be produced under the pattern because the pattern which should be adhered to the uneven surface of the article cannot be adhered to the surface of the article while it fully imitates the uneven surface of the article and therefore the pattern is possibly damaged. Furthermore, since the decorative sheet has to be adhered to the article to be decorated, the effectiveness of the operation is disadvantageously lower in comparison with a direct decorative process for the article to be decorated.

Another conventional method is a method in which wood flour is mixed into an ink layer etc. of a print pattern of a transfer film to give a fine unevenness to the surface of the water pressure transfer article (see Patent Document 2). This method can impart an unevenness at the same time of the water pressure transfer, but since the unevenness obtained by this method is limited to the one in the form of dots, a feeling of unevenness of arbitrary forms such as like a feeling of unevenness like a line of bark, for example other than the dot-like unevenness cannot be obtained and therefore use limits are narrowed. Furthermore, printing the print pattern while the granular mixture ingredient such as wood flour placed into ink will have an undesirable influence to the formation of the print pattern and will also possibly cause much trouble in quality, characteristic, etc. of the pattern.

Further conventional method is a method in which a fine unevenness is formed on the surface of the article with a base coat layer having an surface unevenness applied to the article before the transfer of the print pattern or a topcoat having variant unevenness formed by a press-molding machine etc. after the transfer, but before hardening the print pattern (see Patent Documents 3). Since this method does not form a three-dimensional unevenness portion into the print pattern itself, but imparts the feeling of unevenness to the pattern by forming the unevenness in the base coat or the top coat, it cannot be applied to the decorative surface having neither the base coat nor the top coat. Especially, since the step of imparting the unevenness to the top coat is carried out by the press process before being hardened, the process of operation will increase and a real feeling cannot be obtained because the unevenness is not formed in the pattern itself.

There has been proposed a water pressure transfer in which a glossy variation property according to a degree of a fine unevenness is imparted to an ink printed portion of a decorative layer applied to a surface of an article by changing a degree of absorption of particles of an ultraviolet ray hardening resin composite for activating an ink into the ink printed portion according to oil absorption of pigments of an ink, or a concentration of the ink (see Patent Documents 4). Since this method only changes a glossy feeling to the ink printed portion of the decoration layer, a visual cubic effect can be recognized, but a tactile cubic effect felt by actual touch by hand cannot be obtained.

[Patent documents 1] JP05-270199A
[Patent documents 2] JP06-040198A
[Patent documents 3] JP07-276899A
[Patent documents 4] JP3881002 B

DISCLOSURE OF THE INVENTION

Problems to be Solved by the Invention

A first problem to be solved by this invention is to provide a water pressure transfer method adapted to form three-dimensional fine unevenness of arbitrary patterns in the print pattern itself whereby a real concavo-convex tactile feeling without a particular process therefor.

A second problem to be solved by this invention is to provide a transfer film for water pressure transfer suitable for forming three-dimensional fine unevenness of arbitrary patterns in the print pattern itself whereby a real concavo-convex tactile feeling without a particular process therefor.

A third problem to be solved by this invention is to provide a water pressure transfer article having a real concavo-convex tactile feeling based on three-dimensional fine unevenness of arbitrary patterns.

Means to Solve the Problems

A fundamental feature of this invention lies in imparting a three-dimensional unevenness tactile feeling to a surface of an article by transferring a surplus portion of an activating agent used for activating a print pattern of a transfer film in a space (a middle space) between adjacent ink printed portions of a print layer formed by carrying out a water pressure transfer of the print pattern of the transfer film on the surface of the article while the surplus portion of the activating agent is collected in the convex form whereby convex portions higher than the ink printed portions are formed in this middle space. This feature can be accomplished by the following means to solve the problems.

First means to solve the problems is to provide a method for activating a print pattern of a transfer film formed by applying the print pattern on a water-soluble film with an activating agent and thereafter carrying out a water pressure transfer of said print pattern on a surface of an article, said method comprising the steps of preparing said transfer film having said print pattern including a first area of an ink layer and a second area of no ink layer or an ink layer thinner than that of said first area and having no whole outer surface fixture layer; forming activating agent convex collection portions by protruding on said surface of said article a surplus portion of said activating agent which is applied onto said surface of said transfer film to activate an ink of said first area while said surplus portion of said activating agent is collected in said second area by being pushed by said surface of said article on said water pressure transfer; and shrinking said activating agent convex collection portion when said print pattern on said article is hardened whereby an ink print portion corresponding to said second area projects over an ink print portion corresponding to said first area to thereby impart a three-dimensional unevenness shape to said surface of said article surface.

Second means to solve the problems is to provide a method for activating a print pattern of a transfer film formed by applying said print pattern on a water-soluble film with an activating agent and thereafter carrying out a water pressure transfer of said print pattern on a surface of an article, said method comprising the steps of preparing said transfer film having said print pattern including a first area of an ink layer and a second area of no ink layer or an ink layer thinner than that of said first area and having no whole outer surface fixture layer; forming activating agent convex collection portions by collecting in a convex manner on a surface of said second area by a repelling function of said ink layer of said first area and a collection power of said activating agent a surplus portion of said activating agent which is applied onto said surface of said transfer film to activate an ink of said first area; thereafter carrying out concavo-convex reversal of said activating agent convex collection portion on said second area when said print pattern of said transfer film is transferred onto said surface of said article under water pressure; and shrinking said activating agent convex collection portion when said print pattern on said article is hardened whereby an ink print portion corresponding to said second area projects over an ink print portion corresponding to said first area to thereby impart a three-dimensional unevenness shape to said surface of said article surface.

In the second means to solve the problems, the collection of the surplus portion of he activating agent may be preferably carried out by setting an interfacial tension of the ink relative to the activating agent in the first and second areas so that the activating agent collection power in the second area acts more greatly than a power for the ink layer of the first area to draw the activating agent and setting the interfacial tension may be carried out so that the interfacial tension relative to the activating agent in the first area gets lower than the interfacial tension relative to the activating agent in the second area.

In order to promote the transfer of the surplus portion of the activating agent to the second area, the activating agent mat preferably contains 0.01 through 3 weight % of leveling agent.

The activating agent may be a solvent including or excluding type ultraviolet ray hardening resin composite and the activating agent convex collection portion may be preferably hardened by ultraviolet ray when the print pattern is hardened by the ultraviolet ray.

The water pressure transfer may be preferably carried out by attaching the transfer film around the surface of the article so that the transfer film is shrunk in at least one of longitudinal and latitudinal directions and the step of attaching the transfer film around the surface of the article by shrinking the transfer film is carried out so that a speed at which the transfer film is attached around the surrounding surface of the article is higher than a speed at which the article contacts the water.

A shrinkage difference may be produced at a boundary of an ink printed portion corresponding to the first area and a portion corresponding to the second area when the activating agent convex portion is shrunk on hardening the print layer on the article.

Third means to solve the problems is to provide a water pressure transfer film having a print pattern applied onto a water soluble film for transferring the print pattern on a surface of an article under water pressure after the print pattern is activated by an activating agent wherein the print pattern comprises a first area of an ink layer and a second area of no ink layer or an ink layer thinner than that of the first area, the second area having a space necessary to collect a surplus portion of the activating agent therein and the transfer film having no whole outer surface fixture layer.

Fourth means to solve the problems is to provide a water pressure transfer article characterized by having a three-dimensional unevenness surface formed by the water pressure transfer method according to the first and second means to solve the problems.

Fifth means to solve the problems is to provide a water pressure transfer article characterized by having a print layer formed by transferring a print pattern of a transfer film under water pressure, the print layer having a convex portion formed in a space between adjacent ink printed portions so as to get higher than the ink printed portions by a reversal operation of collection portions of a surplus portion of an activating agent for activating the print pattern. In this case, the collection portions of the surplus portion of the activating agent may have a recess formed in the collection portions of the surplus portion of the activating agent adjacent to a boundary between the collection portion and the ink printed portion so as to be lower than the ink printed portion.

Effect of the Invention

In accordance with the invention, since the fine three-dimensional unevenness is imparted between the ink printed portions of the print layer on the surface of the article, there can be obtained an unevenness property integrated with the decoration of the article. Thus, there can be obtained not only a merely visual cubic effect, but also a real three-dimensional tactile feeling corresponding to the print pattern on the surface of the article, which can improve a surface decoration nature of the article.

Since this three-dimensional unevenness is formed by collecting the surplus portion of the activating agent used for activating the print pattern when the water pressure transfer of the print pattern is carried out by the surplus portion of the activating agent flowing into the second area and by the repelling operation of the activating agent and the collecting power of the activating agent itself in association with or independently from the surplus portion of the activating agent flowing into the second area, the unevenness tactile feeling can be obtained with a high effectiveness of operation without any requirement of separate process.

Since the three-dimensional unevenness can be formed by the surplus portion of the activating agent collected in the second area having no ink or the thinner ink applied thereto and being automatically transferred in the state of concavo-convex reversal when the water pressure transfer of the print pattern of the transfer film on the surface of the article is carried out, the three-dimensional unevenness can be easily formed simultaneously with water pressure transfer.

As the transfer film is shrunk in at least one of the longitudinal and latitudinal directions and attached around the surface of the article, the convex collection portions of the activating agent in the second area are transferred onto the surface of the article while it is being pushed up and the resultant three-dimensional unevenness can be more remarkably formed. Such a shrinkage attachment of the transfer film around the article can be more easily accomplished by the speed at which the transfer film is attached around the surface of the article while the convex-concave reversal of the convex collection portions of the activating agent being made higher (as one through three times, for example) than the speed at which the article contacts the surface of the water.

As there occurs the shrinkage difference between the convex collection portions of the activating agent and the ink printed portions corresponding to the first area by the former being more greatly shrunk than the latter when the print layer or the decoration layer (the portion corresponding to the print pattern) on the article are hardened, the convex collection portions of the activating agent in the space corresponding to the second area are more highly protruded and in addition thereto, recesses are formed at the boundary between the portions corresponding to the first and second areas, which can impart a more remarkable three-dimensional unevenness to the surface of the article.

Since the three-dimensional unevenness is formed between the first area having the ink of the print pattern and the second area having no ink of the print pattern or the ink more thinly printed, the unevenness can be imparted having arbitral patterns such as strips corresponding to slits (the second areas) between the ink printed portions of the print pattern, which can enlarge the range of usage.

BRIEF DESCRIPTION OF THE DRAWINGS

FIGS. 3A-3 F shows one form of the water pressure transfer method of the invention sequentially in order of steps of operation wherein FIG. 3A is a sectional view of a transfer film.

FIGS. 4A-4E show schematic diagrams illustrating the steps of the method according to the first form of the invention wherein FIG. 4A is a sectional view of the transfer film, FIG. 4B is a sectional view of the state where the activating agent is applied to the transfer film, FIG. 4C is a sectional view of the state where a surplus portion of the activating agent is pushed by the surface of the article to form a convex portion on the side opposite from the surface of the article, FIG. 4D is a sectional view of the state where the convex portion of the surplus portion of the activating agent is further heightened by the surface of the article engaging the first area of the print pattern and FIG. 4E is a sectional view of the state where the convex portion of the surplus portion of the activating agent is further heightened by shrinkage when it is hardened;

FIGS. 5A-5D show schematically sectional views explaining the state where the transfer film is attached around the article according to the first form of the invention wherein FIG. 5A illustrates that the article is moving toward the transfer film having the print pattern activated by the activating agent, FIG. 5B illustrates that the article is forced against the transfer for transferring the print pattern of the transfer film under water pressure, FIG. 5C illustrates that the print pattern is attached around the surface of the article while the convex portion of the surplus portion of the activating agent is being formed and FIG. 5D illustrates the convex portion of the surplus portion of the activating agent is further heightened.

FIGS. 6A-6F show schematic diagrams illustrating the steps of the method according to the second form of the invention wherein FIG. 6A is a sectional view of the transfer film, FIG. 6B is a sectional view of the state where the activating agent was applied to the transfer film, FIG. 6C is a sectional view of the state where a surplus portion of the activating agent is collected to form a convex portion of the surplus portion of the print pattern in the second area of the print pattern of the transfer film, FIG. 6D illustrates the article is moving toward the transfer film, FIG. 6E illustrates the convex portion is pushed by the surface of the article so as to move through the second area of the print pattern on the side opposite to the surface of the article and protrude reversely therefrom and FIG. 6F illustrates the convex portion of the surplus portion of the activating agent is further heightened by shrinkage when it is hardened;

FIGS. 7A-7D show schematically sectional views explaining the state where the transfer film is attached around the article according to the second form of the invention wherein FIG. 7A illustrates that the article is moving toward the transfer film having the print pattern activated by the activating agent, FIG. 7B illustrates that the article is forced against the transfer film for transferring the print pattern of the transfer film under water pressure while the formed convex portion reversely protrudes corresponding to FIG. 6E, FIG. 7C illustrates that the print pattern is attached around the surface of the article and FIG. 7D illustrates the convex portion of the surplus portion of the activating agent is further heightened corresponding to FIG. 6F.

BEST MODE OF EMBODIMENT OF INVENTION

Figure 1:
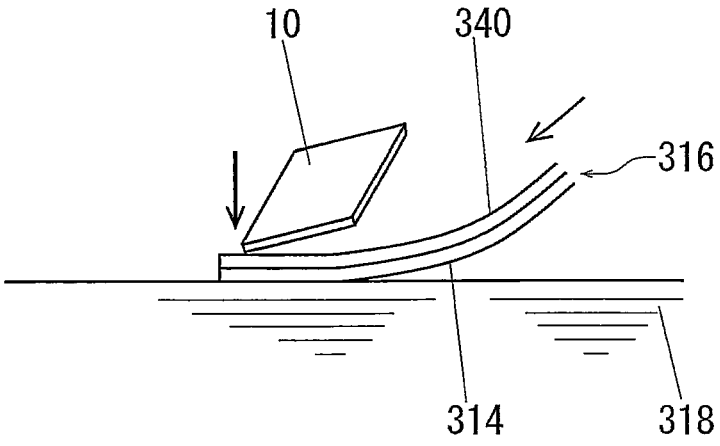
FIG. 1 is a schematic diagram showing the outline of a water pressure transfer method to which this invention is applied.
Figure 2:
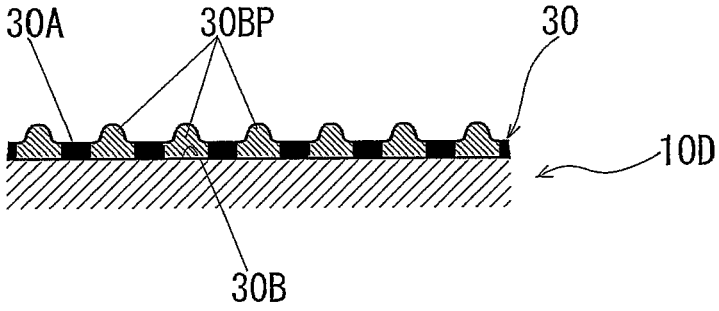
FIG. 2 is a partially enlarged sectional view of a water pressure transfer article obtained by the method of the invention.
Figure 3A:
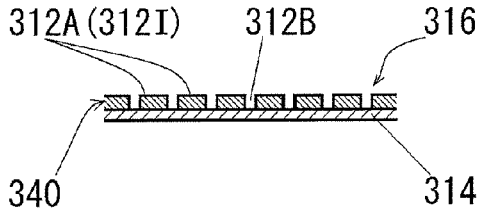
Figure 3B:
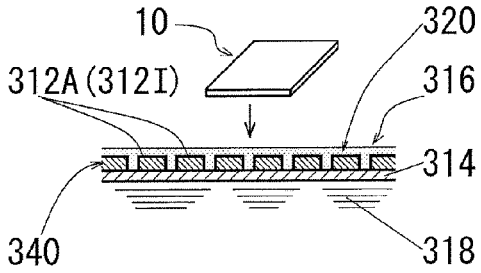
FIG. 3B is a sectional view of the state where the activating agent was applied to the transfer film.
Figure 3C:
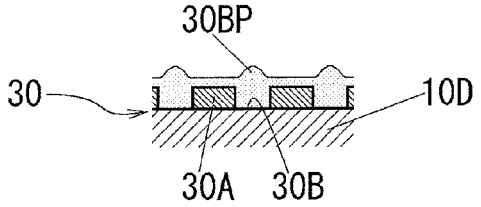
FIG. 3C is a sectional view of the state where the convex portions of the surplus portion of the activating agent are formed on the surface of the article after the transfer.
Figure 3D:
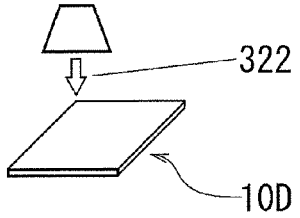
FIG. 3D is a sectional view of the state where the ultraviolet rays are irradiated after water pressure transfer.

Referring to a mode of an embodiment of the invention in details with reference to the drawings, FIG. 1 briefly illustrates a water pressure transfer method to which this invention is applied. This water pressure transfer method is a method in which a transfer film 316 (see FIG. 3(A)) comprising a water soluble film 314 having a print pattern 340 applied thereon is floated on a water 318 within a transfer tub not shown with the print pattern directed upside after an activating agent 320 is applied onto the print pattern 340 to activate the ink and an article 10, which should have the print pattern transferred thereon under water pressure is forced underwater through the transfer film 316 (see FIG. 1 and FIG. 3(B)) to thereby form a decorated article 10D having a print layer (or a decorative layer) 30 (see FIG. 2 and FIG. 3(C)) of a pattern corresponding to the print pattern 340 on the surface of the article 10. An ingredient of the ink of the print pattern 340 and materials of components such as the water-soluble film 314, the activating agent and other elements are not limited to what are described with respect to the mode of the embodiment and examples which are described later and the article 10 may have a suitable ground process applied thereto before the water pressure transfer is carried out.

The water soluble film 314 is formed of water soluble material having a main ingredient of polyvinyl alcohol, for example, which gets wet and is softened by absorbing water. This water soluble film 314 is softened when it contacts the water within the transfer tub to facilitate the water pressure transfer. The print pattern 312 may be applied on the water soluble film 314 by gravure printing and so on and the transfer film 316 may be stored in the state where the ink is dried and activated by using the activating agent when the water pressure transfer is carried out.

Thereafter, the decorated article 10D having the print layer 30 formed thereon passes through a curing step (see FIG. 3 (D)) where the activating agent is hardened, a shower washing step (see FIG. 3 (E)) where the water-soluble film 314 is removed and a drying step (see FIG. 3 (F)) where the surface of the article is dried and then a finished product can be produced.

Although not illustrated, in practice, the article 10 is forced underwater, while it is being conveyed by a suitable conveyor or being supported by a robot arm. In some cases, the step of applying the activating agent 320 on the print pattern 340 and the step of floating the transfer film 316 on the water may be performed in a reverse order where the activating agent 320 may be sprayed on the print pattern 340 of the transfer film 316 which is floated on the water.

In the method of the invention, as shown in FIGS. 4 (A) and 6(A), there is used the transfer film 316 having the print pattern 340 comprising a first area 312A having an ink layer 312I and a second area 312B having no ink layer or an ink layer thinner than the ink layer of the first area 312A, having a space required for collecting a surplus portion of an activating agent provided in the second area 312 and having no whole outer surface pattern fixture layer provided thereon. An interfacial tension of the first area 312A relative to the activating agent is preferably lower than an interfacial tension of the second area 312B relative to the activating agent, and the reason for it will be described later.

As the activating agent 320 is applied on the transfer film 316, this activating agent 320 activates the ink layer 312I in the first area 312A of the print pattern 312 while it permeates this ink layer 312I to restore the adhesion having the same state as the one when the ink layer is printed, which enables the water pressure transfer of the print pattern 312 to be performed. As described in details later, at the same time as the above activation, a surplus portion 320R of the activating agent 320 used for activating the print pattern 312 is transferred to a space (a middle space) between the adjacent ink printed portions 30A of the print layer (the decoration layer) 30 (see FIG. 2) formed by the print pattern 340 of the transfer film 316 being transferred under water pressure while it is collected in the convex sate so that convex portions 30BP higher than the ink printed portions 30A are formed in the middle spaces 30B to impart three-dimensional concavo-convex tactile feeling.

In this manner, there are two following forms in order to collect the surplus portion of the activating agent for activating the print pattern 340 of the transfer film 316 in the convex state between the adjacent ink printed portions 30A of the print layer 30 on the article to thereby form the convex portions 30BP. As described later in detail with reference to FIGS. 4 and 5, the first form is the one in which the surplus portion 320R of the activating agent applied on the transfer film 316 is transferred onto the surface of the article while it is collected between the ink printed portions 312A of the print pattern 340 on water pressure transfer so that the surplus portion 320R of the activating agent flows into the adjacent ink printed portions 312A to thereby form the convex portions 30BP. As described later in detail with reference to FIGS. 6 and 7, the second form is the one in which the surplus portion 320R of the activating agent is collected in the second area 312B by means of the repelling operation of the ink layer 312I in the first area 312A of the print pattern 340 and the collecting power of the activating agent 320 and thereafter, the concavo-convex reversal of the activating agent convex collection portions 320C in the second area 312B is carried out on the surface of the article on water pressure transfer to thereby form the convex portions 30BP. It will be considered that the process according to the first form and the process according to the second form are independently or simultaneously performed and each of the processes will be concretely described later. In either case, the activating agent is necessary to be applied at the amount of the surplus portion required to form the convex portions 32BP exceeding the amount for permeating the ink printed portions 312 to activate the ink.

The process according to the first form is shown in FIGS. 4 and 5. As shown in FIG. 4 (B), as the activating agent 320 is applied on the transfer film 316 shown in FIG. 4 (A), the activating agent 320 permeates the ink layer 312I in the dried first area 312A of the print pattern 312 to restore the adhesion of the ink layer 312I. Therefore, as the article 10 is forced down underwater from above together with the transfer film 316, the print pattern 312 is transferred under water pressure so as to become the print layer (the decoration layer) 30 on the surface of the article 10 and at that time, the surplus portion 320RA of the activating agent 320 above the first area 312A and the surplus portion 320RB of the activating agent 320 in the second area 312B are collected while they are pushed down by the surface of the article 10 and flow into the second area 312B by their fluidity (see FIG. 4 (C)). Thus, these surplus portions of the activating agent 320 are transferred in the convex form into the space 30B (the portion corresponding to the second area 312B) between the adjacent ink printed portions 30A (the portions having the ink of the print layer 30) corresponding to the ink printed portions 312I of the first area 312A to form the convex portion 30BP by the collection of the activating agent in the space 30B (see FIG. 4 (C)). This convex portion 30BP may have a more remarkable vertical height difference by providing a shrinkage difference at the time of hardening to form a crevice lower than the ink printed portions 30A surrounding the convex portion 30BP as described in detail with reference to FIG. 6 (F) relating to the second form.

The state where the article 10 is pushed underwater via the transfer film 316 is shown in FIG. 5 in detail. In this case, if a speed at which the transfer film 316 is attached around the article 10 is so set to be higher than a speed at which the surrounding surface of the article 10 is attached to the water, the height of the convex portion 30BP desirably becomes much more remarkable. The reason is the same as the reason for the second form later described with reference to FIG. 7. In FIGS. 1 and 4, the article 10 is shown to be conveniently flat, but in FIG. 5, the article 10 is shown in the form having the height and roundness in order to more easily explain the state where the transfer film 316 is attached around the article.

Although the activating agent 320 may be conventional solvent type activating agent, it may be preferably an ultraviolet ray hardening resin composite containing a photo-polymerization monomer which can give activation to the ink, especially a non-solvent type ultraviolet ray hardening resin composite. The activating agent 320 may be applied onto the transfer film 316 by either of a photogravure roll, a wire bar coating, or a spraying, for example. To the activating agent may be added a leveling agent, a sensitizer, a filler, an inactive organic polymer, a thixotropy imparting agent, a thermal polymerization prohibition agent, a delustering ingredient, etc. The convex portion 30BP formed in the space 30 may be of a solvent containing resinous component hardened by removing the solvent or may be of a non-solvent resinous component hardened by the ultraviolet ray.

The process of the second form is shown in FIGS. 6 and 7. As the activating agent 320 is applied to the transfer film 316 of FIG. 6(A) as shown in FIG. 6 (B), the activating agent 320 permeates the dried ink layer 312I of the first area 312A of the print pattern 312 to recover the adhesion of the ink layer 312I, and meantime, as shown in FIG. 6 (C), the surplus portion 320R of the activating agent is transferred to the second area 312B while it is repelled by the low interfacial tension of the ink layer 312I and the activating agent collects in the convex form in the second area 312B by the action of the collecting power of the activating agent itself in the second area 312B. Referring to FIG. 6 (C), it will be understood that the surplus portion of the activating agent 320 collects from the first area 312A having the ink layer 312I to the second area 312 having no ink layer (or having the thinner ink layer) so that it rises slightly. The rising portion will be referred to as an activating agent convex collection portion 320C later. The height of this activating agent convex collection portion 320C is several micrometers.

Adjustment of the interfacial tension of the ink layer 312I to the activating agent 320 may be performed by adjusting the leveling agent in the activating agent 320. As the leveling agent in the activating agent 320 increases, the interfacial tension of the ink layer 312I of the first area 312A to the activating agent 320 can be lowered and the collecting power of the activating agent 320 to the second area 312B can be heightened. In case where the second area 312B has the ink layer thinner than the ink layer 312I of the first area 312A, the thickness of the ink layer of this second area 312B should be set up to such an extent that the concavo-convex reversal as described later is not prevented. For example, in case where the thinner ink layer is provided in the second area 312B by gravure printing, this thinner ink layer may be preferably provided n the form of very fine dot independent from each other and completely dissolved by the activating agent while it colors the activating agent, for example. Thus, as the material (the thinner ink layer or the activating agent) with which the second area 312B is filled up is colored, the flesh color of the surface of the article recognized visually when not colored can be concealed, and an appearance of the print layer or decoration layer 30 of the surface of the article can be made better.

The leveling agent blended in the activating agent may be suitably adjusted according to an affinity with the composition of the ink of the print pattern 340. If the amount of the leveling agent is too small (there is no leveling property), then the repelling operation by the ink layer 312I of the first area 312A is too strong and the collecting power of the activating agent to the second area 312B increases, but a tendency for sufficient permeation (activation) of the activating agent into the ink layer 312I cannot be maintained. Reversely, if the amount of the leveling agent is too many, the repelling operation by the ink gets lower, the collecting power of the activating agent is lowered, and as a result, the height of the activating agent convex collection portion 320C gets lower and the convex portion 30BP formed by the concavo-convex reversal disadvantageously has a tendency to be lowered by its leveling. Therefore, the leveling agent should be adjusted in the range where such a disadvantage never occurs. The desirable leveling agent may be a silicon system leveling agent such as an organic denaturation polysiloxane, an acrylic leveling agent such as polyacrylate or a UV coating leveling agent having a frame of dimethylpolysiloxane commercially available under the name (the registered trade name) of BYK▲R▼-UV3500. These leveling agents may be preferably contained in the activating agent at the rate of 0.01 through 3 weight %. As the collecting power of the activating agent is heightened, the height of the activating agent convex collection portion 320C of the second area 312B has the tendency to become higher than the height of the first area, but this height differs on the characteristic of respective areas, i.e., the ingredients such as the solid content of the ink or the pigments, an interval of the areas, the amount of application of the activating agent, etc. For example, the collecting power of the activating agent may be preferably set to be high so that the second area 312B may become higher than the first area 312A by about 2-10 micrometers.

Also, the activating agent 320 used for the second form may preferably comprise the non-solvent type ultraviolet ray hardening resin composite having photo-polymerization monomer blended with a predetermined amount of the leveling agent. This activating agent may be also applied onto the transfer film 316 by either of the methods of the photogravure roll, the wire bar coating and the spraying. To this activating agent may be also added a leveling agent, a sensitizer, a filler, an inactive organic polymer, a thixotropy imparting agent, a thermal polymerization prohibition agent, a delustering ingredient, etc.

In order to heighten the interfacial tension to the activating agent 320 (in order to make better the wetting of the surface to be used as the second area of the water-soluble film), a surface treatment such as a surface improvement or the like by UV irradiation, for example, may be performed to the water-soluble film 314 before the print pattern is applied. With such a treatment performed, the collecting power of the activating agent 320 of the second area 312B can be further heightened.

In this manner, the print pattern 340 is transferred under water pressure onto the article 10 using the transfer film 316 having the activating agent convex collection portion 320C formed in the second area 312B by applying the print pattern activating agent 320, as shown in FIG. 6 (D) and at that time, the print pattern 340 of the transfer film 316 is transferred onto the surface of article 10 while the concavo-convex reversal is carried out so that the activating agent convex collection portion 320C of the second area 312B may be pushed up toward the water-soluble film 314 of the transfer film 316 as shown in FIG. 6 (E). In other words, the activating agent convex collection portion 320C having the convex formed toward the opposite side to the water-soluble film 314 of the transfer film 316 is reversed by the water pressure transfer so that the portion having the convex until now is pushed as a reaction by the surface of the article 10 until the convex is formed toward the water soluble film 314 to thereby form the portion 30BP having the convex formed toward the decoration layer 30 (the layer formed by attachment of the print pattern 340). This concavo-convex reversal of the activating agent convex collection portion 320C can be accomplished by having the portion of no ink layer or of the thinner ink layer on the print pattern 30 and also by having no whole outer surface pattern fixture layer surrounding the whole outer surface of the print pattern 340.

The concavo-convex reversal of the activating agent convex collection portion 320C may be preferably performed by attaching the transfer film 316 around the surface of the article 10 so as to shrink the transfer film 316 in at least one of longitudinal and latitudinal directions. This attachment of the transfer film 316 around the surface of the article 10 due to its shrinkage can be performed so that the speed at which the transfer film is attached around the article is set to get higher than the speed at which the surrounding surface of the article is attached onto the water. In this manner, the protrusion of the portion 320C (the convex portion 30BP) can be made more remarkable.

Figure 7A:
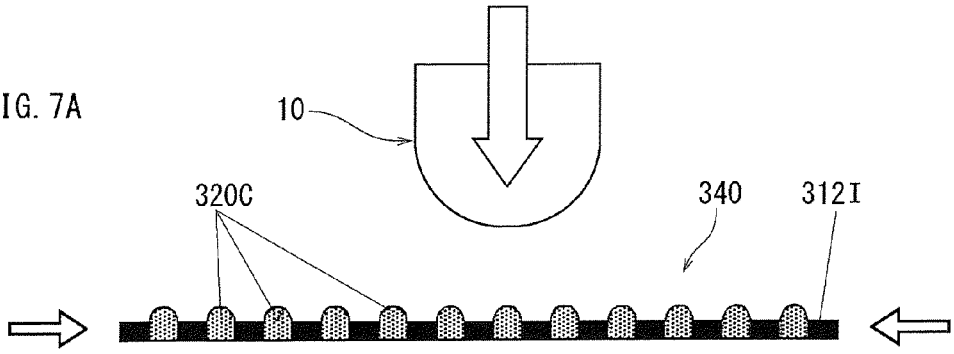
Figure 7B:
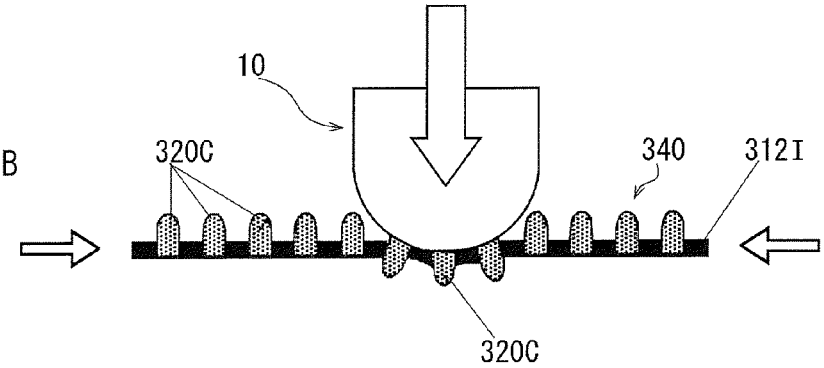
Figure 7C:
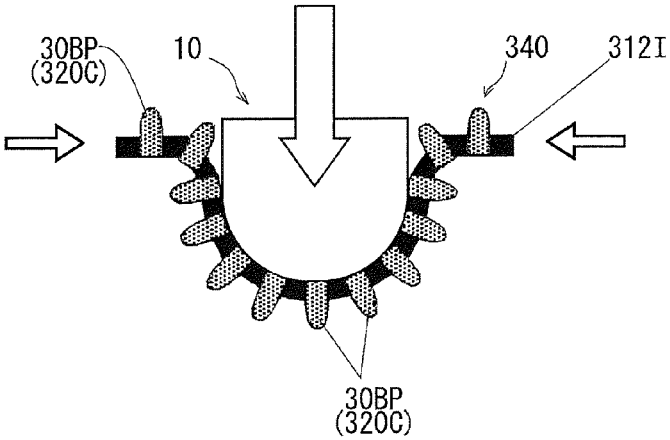
Figure 7D:
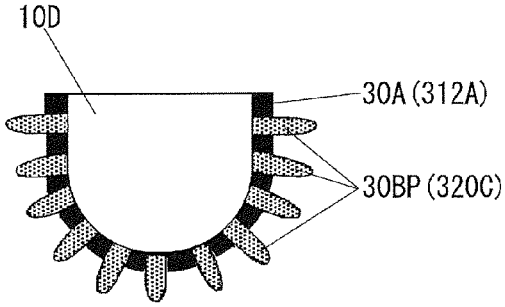

Explaining this movement more concretely with reference to FIG. 7, as the print pattern 340 is transferred so as to move the print pattern 340 toward the article 10 along the longitudinal direction as shown in FIGS. 7(B) and 7(C) when the article 10 should be pushed against the print pattern 340 as shown in FIG. 7(A), the print pattern is transferred so as to be moved along the article 10 while a gap between the second area 312B and the first area 312A is being narrowed. Practically, since the first area 312A has the ink layer 312, but the second area 312B has no ink layer or the thinner ink layer, the width of the second area 312B is narrowed before the width of the first area 312A is narrowed. Thus, the surplus portion of the activating agent is collected so that the activating agent projects still more highly within the narrowed second area 312B (see FIG. 7(B)). In this manner, since the activating agent surplus portion in the state of projecting much more highly contacts the surface of the article 10 from above, when the concavo-convex reversal is carried out by being pushed by the surface of the article 10, the activating agent surplus portion has the more remarkable convex toward the water-soluble film 314 (see FIG. 7 (D)).

In order to shrink the print pattern 340 so as to be brought near the article 10, in case of water pressure transfer using a stationary water type transfer tub (water pressure transfer performed by floating a new transfer film of predetermined size within the transfer tub for every transfer), the article is immersed underwater while the water soluble film 314 made fully wet on the water within the transfer tub is brought near the point where the water soluble film lands on the water from both sides of the water soluble film and in case of water pressure transfer using a running water type transfer tub where the water runs from upstream to downstream, the print pattern 340 can be narrowed so that the print pattern 340 on the water soluble film 314 is brought further near the article 10 while the relative speed of the article 10 and the water stream is so set that the article moves more slowly (so that the speed of the water stream gets higher).

Figure 3E:
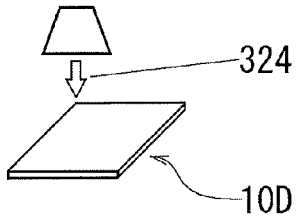
FIG. 3E is a sectional view of the state where a water-soluble film was washed out from the article and FIG. 3F is a sectional view the state where the surface of the article is dried.
Figure 3F:
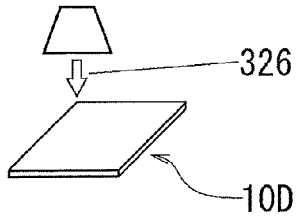
Figure 4A:
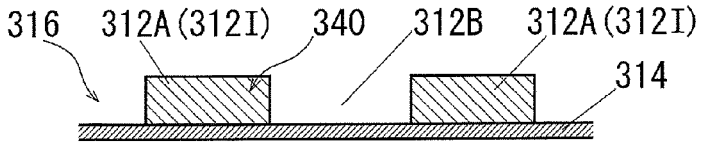
Figure 4B:
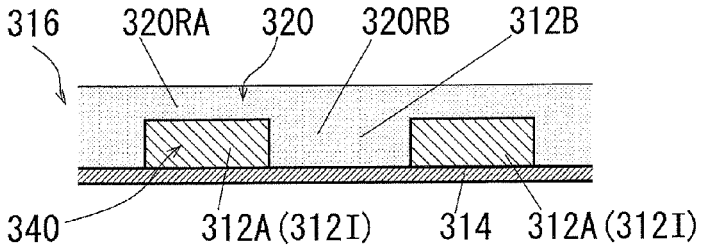
Figure 4C:
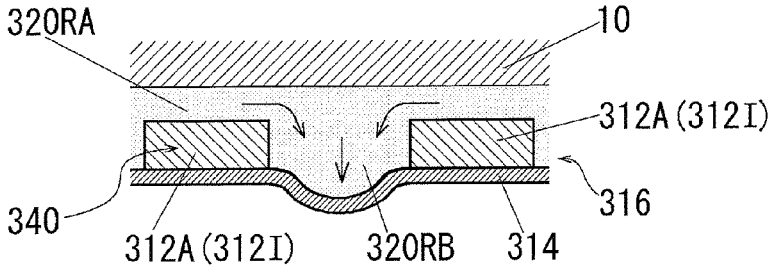
Figure 4D:
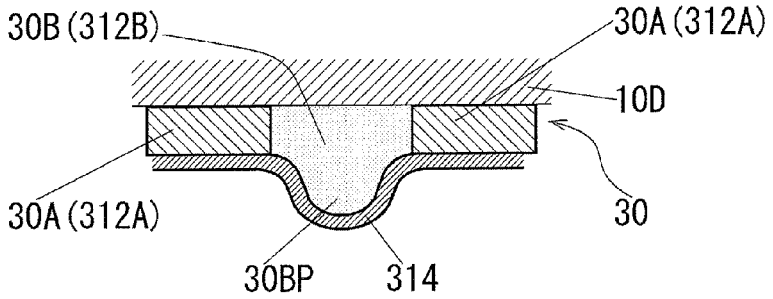
Figure 4E:
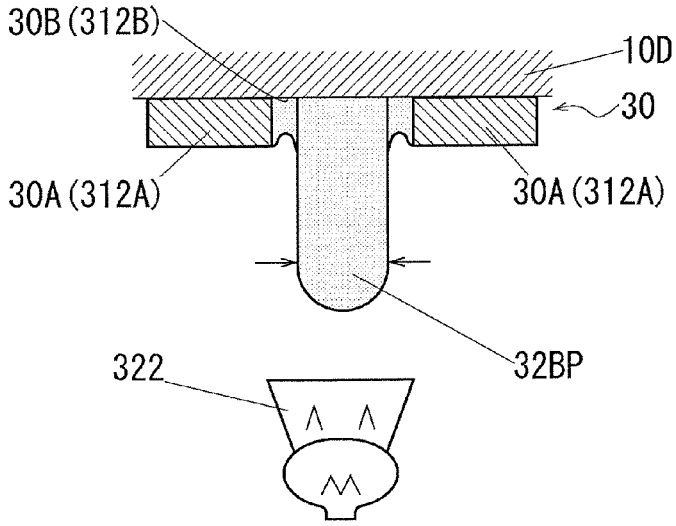
Figure 5A:
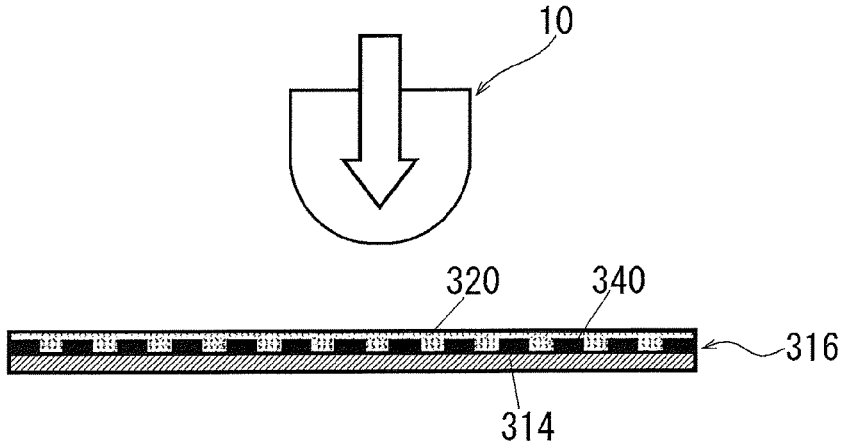
Figure 5B:
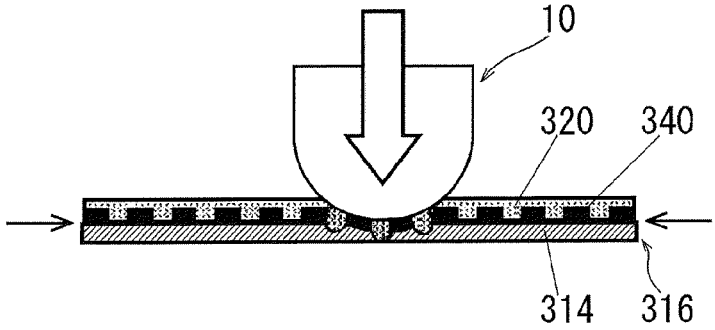
Figure 5C:
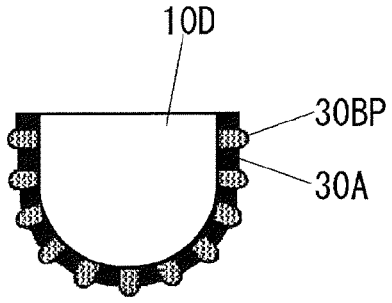
Figure 5D:
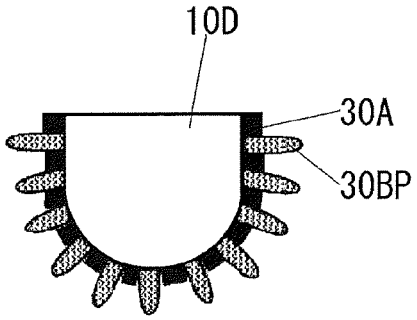
Figure 6A:
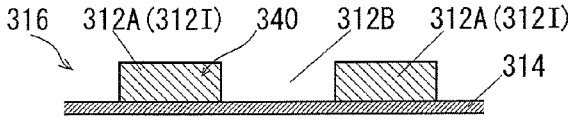
Figure 6B:
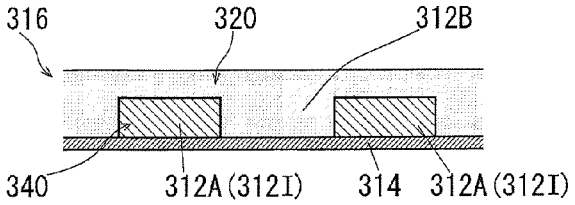
Figure 6C:
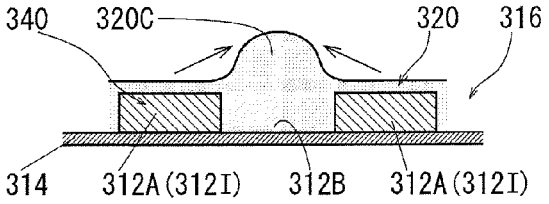
Figure 6D:
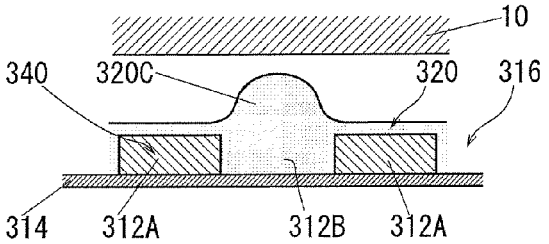
Figure 6E:
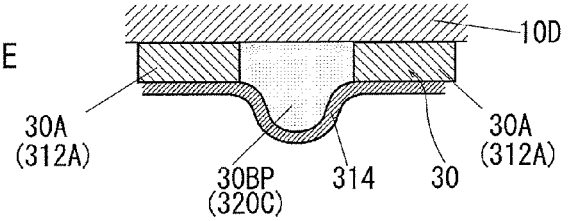
Figure 6F:
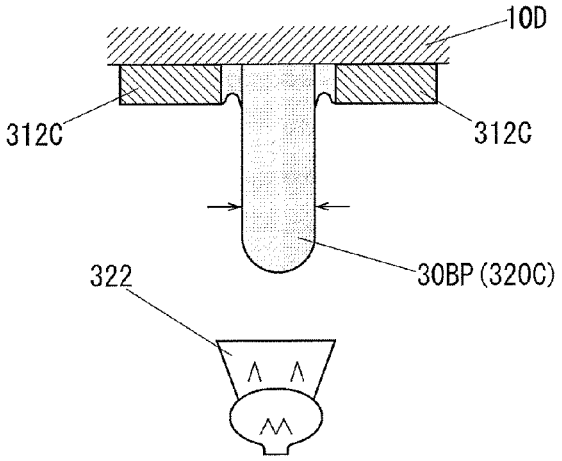

After the step of the concavo-convex reversal of FIG. 6 (E), FIGS. 7 (C) and (D), the print layer or decoration layer 30 (the original print pattern 340) is hardened by UV ray irradiation using a UV ray irradiation hardening apparatus (see FIG. 3 (D) and FIG. 6(F)), thereafter as explained with reference to FIG. 3(E), the water soluble film 314 remaining on the surface of the article is removed by the shower washing machine 324 and finally the surface of the article 10 is dried by the drier 326 (an air blower, for example) to complete the decorated article 10D having the fine concavo-convex surface. In this invention, the step of hardening the decoration layer 30 (see FIG. 3(D)) and the step of removing the water-soluble film 314 (see FIG. 3(E)) may be made reverse. Otherwise, the dryness of the surface of the article 10D may be naturally made.

Hardening of the decoration layer 30 is made by thermally hardening in case of the solvent type activating agent to be used and by ultraviolet ray hardening in case of the ultraviolet ray hardening type activating agent to be used. A proper process is selected according to the activating agent to be used.

Hardening of the decoration layer 30 should be preferably made so as to make it hardened from the surface of the decoration layer 30. In this manner, as shown in FIG. 6 (F), the decoration layer 30 begins to shrink while the surface of the convex portion 30BP of the decoration layer 30 is hardened from the top of the convex portion 30BP to the side thereof and the interior of the convex portion 30BP begins to gradually shrink so as to follow the surface hardening. Thus, a modification of the interior having the softness occurs and the convex shape may be tapered off upwardly by making the interior thinner, which improves a finger contact feeling of the article. Especially, as the speed of hardening is higher, the shrinkage of the convex portion 30BP becomes still larger and that the height (tapering off) increases and therefore the concavo-convex difference can be suitably set up also by adjusting the hardening speed (see FIGS. 5(D) and 7(D)).

The first area 312A having the ink layer 312I can control its shrinkage by using the ink of more solid content or the pigments of higher concentration. Thus, a bigger shrinkage difference can be provided between the first area 312A and the second area 312B by controlling the shrinkage of the ink whereby the convex shape of the convex portion 30BP may be further tapered off.

The UV ray irradiation-hardening apparatus 322 for hardening the decoration layer 30 may be in the arbitrary forms containing a low-pressure or high-pressure mercury lamp or a light source lamp such as a metal halide lamp and an irradiation device (a lamp house).

The UV irradiation hardening apparatus 322 may be preferably adapted to harden the surface of the activating agent convex collection portion 320C (the convex portion 30BP) at a dash by the UV ray irradiation. In this manner, when the surface coat is formed at a dash, the shrinkage modification of the ink printed portion (the first surface portion) 30A corresponding to the first area 312A and the portion (the second surface portion) 30B corresponding to the second area 312B can be remarkably made. In other words, when hardening of the activating agent convex collection portion 320C is carried out at a dash in this way to raise the shrinkage modification, "pulling" occurs from both of the first surface portion 30A and the second surface portion 30B simultaneously on their boundary line of the first surface portion 30A and the second surface portion 30B. Thus, the convex portion 30BP can be further heightened because there is formed the crevice having a low height difference shown in FIG. 6(F) on the side of the convex portion 30BP (which is lower than the ink printed portion of the decoration layer 30 or the first surface portion 30A) and the resin at the "pulling" is modified and transferred to the convex portion 30BP of the second surface portion 30B while the amount of the resin decreased by the crevice is shifted to the convex portion whereby much more remarkable concave-convex unevenness can be formed. Incidentally, in case where the activating agent of ultraviolet ray hardening resin composite of solvent content type or solvent un-containing type is used, the activating agent convex collection portion is also hardened by ultraviolet ray irradiation at the time of ultraviolet ray hardening of the print pattern, but since the ultraviolet ray hardening can be carried out in the state where the convex portion 30BP is covered with the water-soluble film 314 without contacting an air by washing and removing the surface water-soluble film after the surface hardening with the result that the surface hardening can be sped up further to thereby make the concavo-convex difference much more remarkable.

In this invention, no provision of a surface protection layer (a top coat layer) may be preferably made because such a surface protection layer damages the cubic effect by the unevenness of the decoration layer 30, but if the surface protection layer having an imitated unevenness of the decoration layer 30, it will not necessarily deny providing the surface protection layer.

Figure 8:
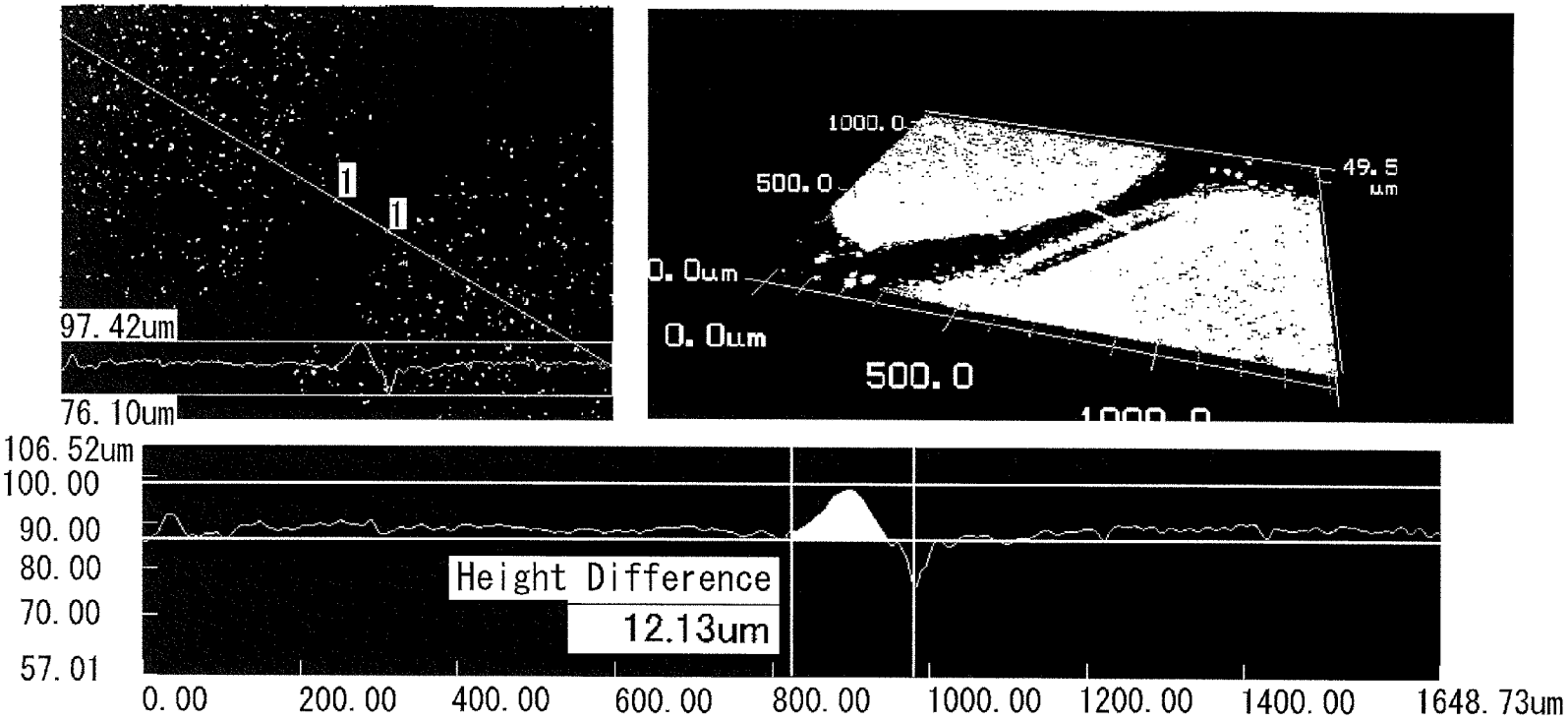
FIG. 8 is a photograph showing the surface of the real product obtained by the Example 1 of the invention and the section thereof in an enlarged manner.

FIG. 8 shows the real decoration article 10D obtained by Examples described below and it will be understood that the fine and remarkable concave-convex unevenness s formed in the surface of the decoration article 10D. Although, in the sectional view of FIG. 2, it is recognized so that the decoration layer 30 is divided into the first surface portion 30A and the second surface portion 30B, practically both of the surface portions are strongly and integrally connected.

EXAMPLE

Figure 9:
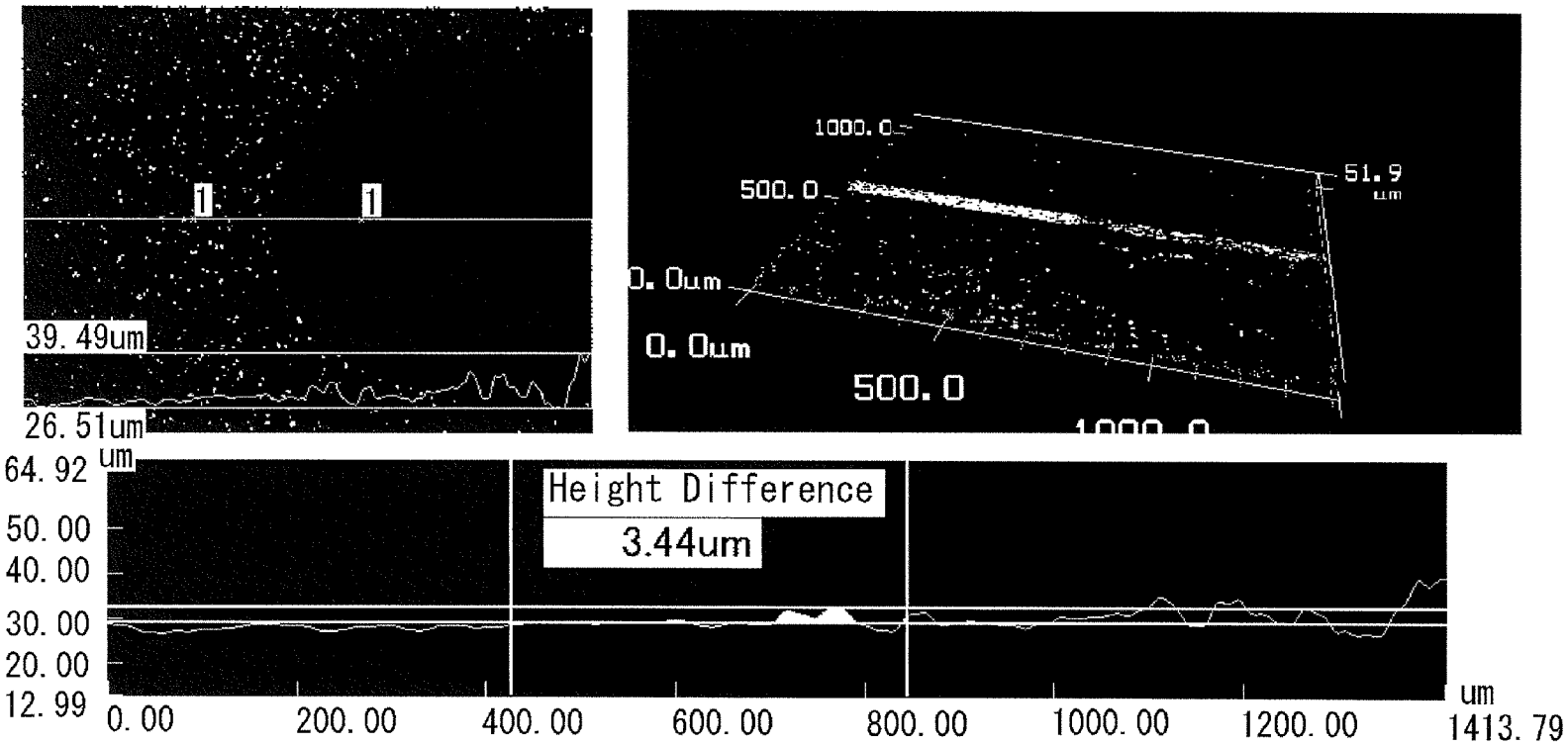
FIG. 9 is a photograph showing the surface of the real product obtained by the Comparison 1 and the section thereof in an enlarged manner.
Figure 10:
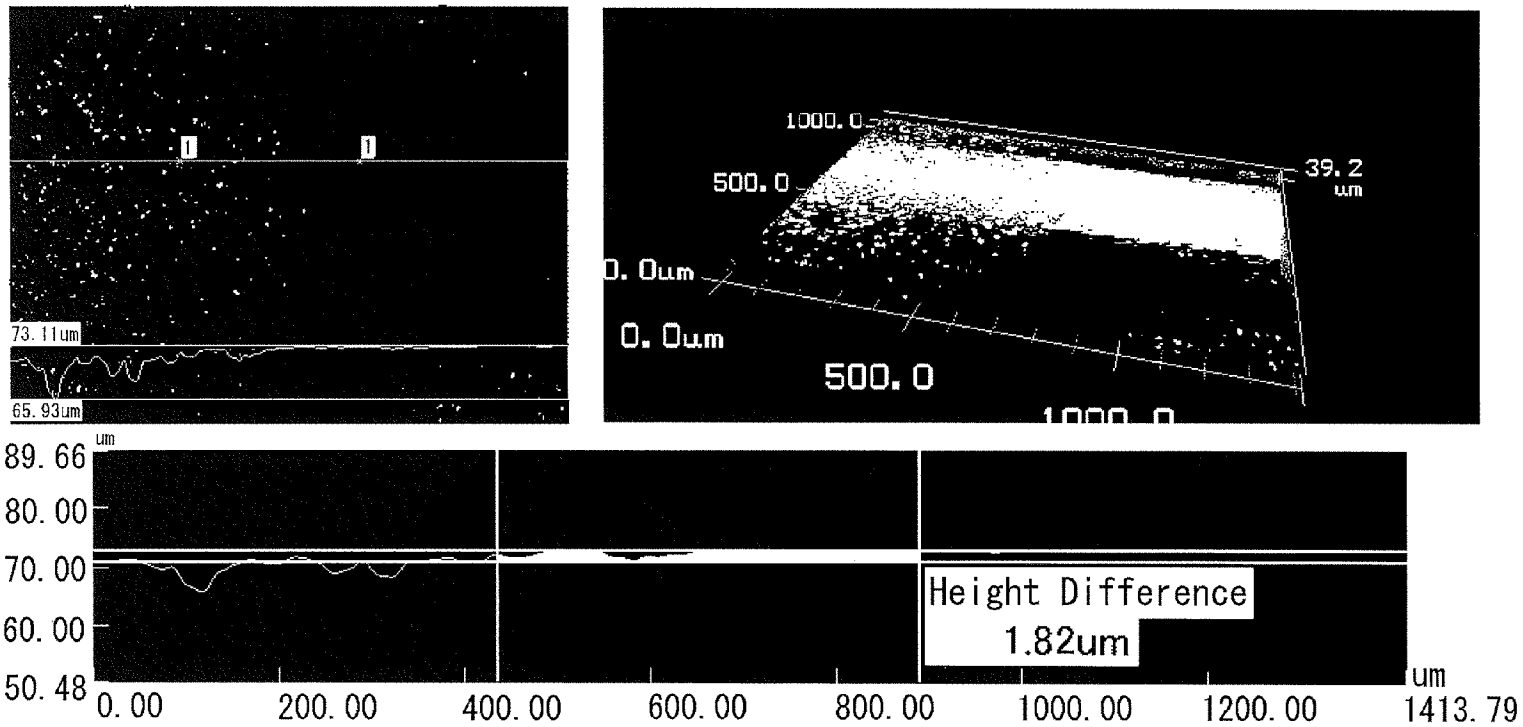
FIG. 10 is a photograph showing the surface of the real product obtained by the Comparison 2 and the section thereof in an enlarged manner.
Figure 11:
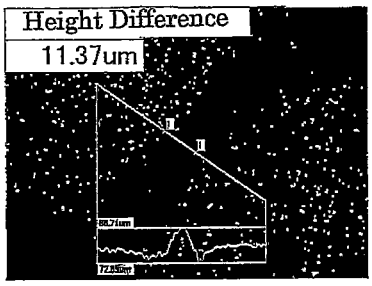
FIG. 11 is a photograph showing the surface of the real product obtained by the Example 2 of the invention and the section thereof in an enlarged manner.
Figure 11:
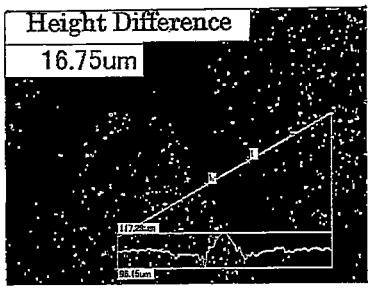
Figure 11:
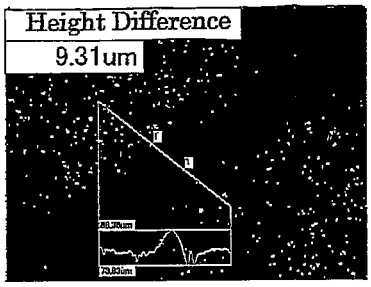

Next, two Examples 1 and 2 will be explained while they are compared with Comparisons 1 and 2 with reference to enlargement photographs of the original decoration articles (FIGS. 8 and 11 are the photographs of Examples 1 and 2 and FIGS. 8 and 11 are the photographs of Comparisons 1 and 2) obtained by these Examples and Comparisons. The photographs and the height differences of the unevenness of FIGS. 8 through 11 are measured by measurement magnification ×1000 with the color laser beam microscope manufactured by "KEYENCE CORP., its controller: VK-8700 and its measurement part: VK-8710 used.

Example 1

Figure 12:
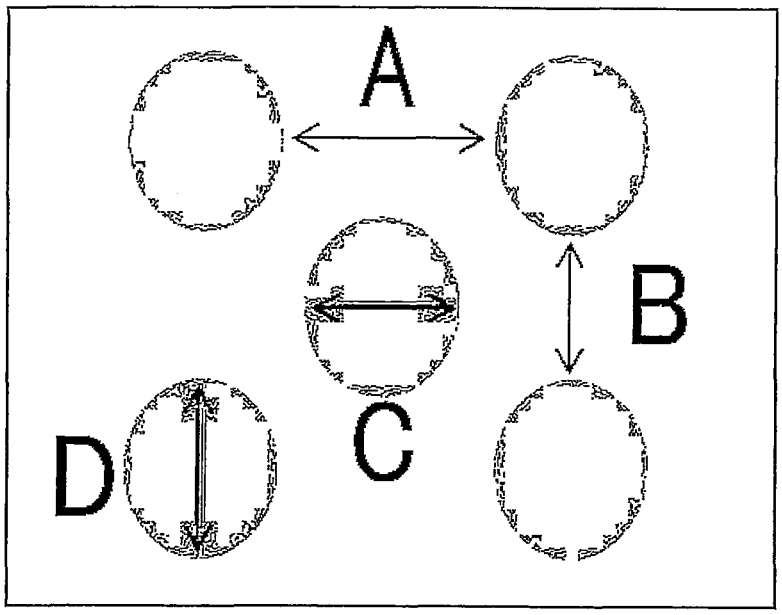
FIG. 12 shows the print pattern of the transfer film used for the Example 1, in an enlarged manner together

This Example 1 was carried out in the following way;

(1) As shown in FIG. 12, the transfer film had the print pattern comprising the print pattern portion (the first area) studded with the dots of ellipse form and the portion having no print pattern between the dots (the second area) and has been commercially sold by Cubic Co., Ltd. one of the applicants to their licensee of the water pressure transfer art under the brand name called "pattern number K0200" of "the circle check black 2C". In this Example, there were used ones having no whole outer surface pattern fixture layer or no whole surface ink layer among the above products. Concretely explaining the pattern of the transfer film of the "circle check", as shown in FIG. 12, the print pattern of pearl pigment system ink layer had the circle form of ellipses (the C section (width) of 684.56 micrometers and the D section (length) 1011.27 micrometer) formed by being alternately aligned at alignment intervals of the A section (length) of 873.88 micrometers and the B section (width) of 580.28 micrometers). The ink layer in the form of ellipse circle had a thickness of about 2 micrometers and the water-soluble film has a thickness of about 40 micrometers. Although what is actually sold has the whole outer surface fixture layer of silver pigment ink etc. on the whole surface thereof, the present invention used the transfer film of the state before applying the whole surface fixture layer.

(2) The plate made of ABS resin having the size of 10 cm×20 cm×3 mm was used for the article which is an object to be pattern-transferred and water pressure transfer of the transfer film was transferred on the article under water pressure in the order of the steps shown in FIGS. 3 (A) through 3 (F).

(3) There was used the activating agent of non-solvent type ultraviolet ray hardening resin composite manufactured and sold by Ohashi Chemical Industries Ltd. under the brand name called "Ubic S clear 33-N2" and this activating agent was applied on the print pattern of the transfer film by the wire bar coating method just before introducing the transfer film into the transfer tub.

(4) The transfer film activated in this manner was supplied to and floated on the water surface in the running water type transfer tub, after forming the concave-convex portion or unevenness by means of the repelling operation and the collecting power of the activating agent, the article was forced through the transfer film underwater to thereby carry out the water pressure transfer, and after taking out the article from the water, the ultraviolet rays were irradiated on the article, the water-washing and drying were performed to obtain the water pressure transfer article (decoration article 10D).

(5) On the surface of the article obtained by these conditions was obtained the decoration layer (the surface pattern) having the unevenness of about 12 micrometer height difference and integral with the pattern.

The enlargement photograph of FIG. 8 shows the state of the surface of the decoration article obtained by Example 1. As noted from the photograph, the decoration layer having the unevenness (height difference of 12.13 micrometers) has the real cubic feeling apparently imparted thereto without any necessity of finger contact.

(Comparison 1)

The Comparison 1 was performed in the same manner as the Example 1 except that there was used the transfer film with the whole outer surface fixture layer of clear ink having silver pigment added thereto formed on the print pattern by gravure printing and having the thickness of the print pattern and the whole surface pattern fixture layer of about 4 micrometers, which was sold by CUBIC Co., Ltd. under the brand name of "pattern number K0200" of "circle check black 2C". Thus, in this Comparison 1, both of the repelling operation and the collecting power of the activating agent were never applied to the surplus portion thereof and therefore the activating agent never collected in the first area. The enlargement photograph of the real article of FIG. 9 shows the surface state of the decoration article obtained by this Comparison 1 and as noted from this photograph, the height difference of the surface unevenness is only about 3 micrometers slightly and even if the unevenness was recognized by the finger touch contact, neither a feeling of unevenness nor a cubic effect was imparted because of the smoother cubic feeling of the pattern. This was caused by no occurrence of concave-convex reversal because the transfer film had the whole outer surface fixture layer.

(Comparison 2)

The Comparison 2 had the same transfer film as in the Comparison 1 used, but differed from the Comparison 1 at the point where there was used the activating agent of solvent type resin composite manufactured and sold by Ohashi Chemical Industries Ltd. under the brand name called "C. P. A-H NORMAL EX." FIG. 10 shows the surface state of the decoration article obtained by this Comparison 2 and as noted from this photograph, the height difference of the surface unevenness is only about 1.8 micrometers slightly. The concavo-convex tactile feeling (the tactile cubic effect) was not imparted to the article. This was also caused by no occurrence of concave-convex reversal because the transfer film had the whole outer surface fixture layer.

Example 2

The Example 2 was performed in the same manner as the Example 1 as shown in FIGS. 7 (A) through 7(D) except that the water pressure transfer was carried out so that the concave-convex reversal was made while the speed at which the transfer film was attached around the article 10 variously changed. The items (A) through (C) of the Example 2 correspond to three cases in which the speeds at which the transfer film was attached around the surface of the article were different from each other, respectively.

Thus, the results as shown in the enlargement photographs of the real articles of FIG. 11 were obtained.

(A) This case was the one where the water pressure transfer was carried out while the speed at which the transfer film was attached around the article when it was forced under water with both sides of the transfer film fixed was the same speed as the speed at which the article was attached onto the water (in case where both of the water stream speed and the conveyor speed of the transfer film was 1.3 m/minute) and as a result, the height difference of the concave-convex portion or unevenness of the "circle check" formed on the article was 11.37 micrometers as shown in the enlargement photograph of FIG. 11 (A).

(B) This case was the one where the speed at which the transfer film was attached around the article was higher about 1.4 times than the speed at which the surface of the article was attached onto the water by narrowing both sides of the transfer film as shown in FIGS. 7 (B) and 7 (C) (in case where the water stream speed was 1.3 m/minute while the conveyor speed of the transfer film was 0.9 m/minute) and as a result, the height difference of the concave-convex portion or unevenness of the "circle check" formed on the article was 16.75 micrometers as shown in the enlargement photograph of FIG. 11 (B). (This was higher about 5.38 micrometers than the case (A)).

(C) This case was the one where the speed at which the transfer film was attached around the article was lower about 0.7 times than the speed at which the surface of the article was attached onto the water by extending both sides of the transfer film in the direction reverse to that shown in FIGS. 7 (B) and 7 (C) (in case where the water stream speed was 1.3 m/minute while the conveyor speed of the transfer film was 1.7 m/minute) and as a result, the height difference of the concave-convex portion or unevenness of the "circle check" formed on the article was 9.31 micrometers as shown in the enlargement photograph of FIG. 11 (C). (This was lower about 2.06 micrometers than the case (A)).

As noted from these cases, the unevenness formed in the article can be made more remarkable by sticking the pattern of the transfer film so that the interval of the patterns of the transfer film (the width or size of the second area) is narrowed. In the specification, "the speed at which the article is attached on the water" has the standard where the print pattern and the surface of the article are adhered closely each other by 1 to 1 as understood from the above explanation, and therefore the specification expresses that in case where the print pattern and the surface of the article are adhered closely each other by less than 1 to 1 so that the print pattern is extended, "the speed at which the article is attached on the water" is lower, while, in reverse case, "the speed at which the article is attached on the water" is higher.

INDUSTRIAL APPLICABILITY

According to the water pressure transfer method of the invention, since the fine three-dimensional unevenness is imparted to the print pattern itself, the concavo-convex characteristic integral with the decoration of the article can be obtained whereby the surface of the article can have the real three-dimensional tactile feeling corresponding to the print pattern. Since the unevenness of the surface of the article is formed by the concave-convex reversal of the convex collection portions of the activating agent which are in turn formed on the transfer film by the flow of the activating agent for activating the print pattern into the spaces between the adjacent ink printed portions by the pressure on the transference of the print pattern and also by the repelling operation by the ink and the collecting power of the activating agent itself, the concavo-convex tactile feeling can be obtained by high workability without any separate step of operation and therefore, the invention has high industrial availability.

The invention claimed is:

1. A method for activating a print pattern of a transfer film formed by applying said print pattern on a water-soluble film with an activating agent and thereafter carrying out a water pressure transfer of said print pattern on a surface of an article, said method comprising the steps of preparing said transfer film having said print pattern including a first area of an ink layer and a second area of no ink layer or an ink layer thinner than that of said first area and having no whole outer surface fixture layer; forming activating agent convex collection portions by protruding on said surface of said article a surplus portion of said activating agent which is applied onto said surface of said transfer film to activate an ink of said first area while said surplus portion of said activating agent is collected in said second area by being pushed by said surface of said article on said water pressure transfer; and shrinking said activating agent convex collection portion when said print pattern on said article is hardened whereby an ink print a portion corresponding to said second area projects beyond an ink print portion corresponding to said first area to thereby impart a three-dimensional unevenness shape to said surface of said article surface.

2. A water pressure transfer method as set forth in claim 1, and characterized in that said activating agent contains 0.01 through 3 weight % of a leveling agent.

3. A water pressure transfer method as set forth in claim 1, and characterized in that said activating agent is a solvent including or excluding type ultraviolet ray hardening resin composite and said activating agent convex collection portion is also hardened by ultraviolet ray when said print pattern is hardened by said ultraviolet ray.

4. A water pressure transfer method as set forth in claim 1, and characterized in that said water pressure transfer is carried out by attaching said transfer film around said surface of said article so that said transfer film is shrunk in at least one of longitudinal and latitudinal directions.

5. A water pressure transfer method as set forth in claim 4, and characterized in that said step of attaching said transfer film around said surface of said article is carried out so that a speed at which said transfer film contact the surrounding surface of said article is higher than a speed at which said surrounding surface of said article contacts said water.

6. A water pressure transfer method as set forth in claim 1, and characterized in that a shrinkage difference is produced at a boundary of said ink printed portion corresponding to said first area and said portion corresponding to said second area when said activating agent convex portion is shrunk on hardening said print pattern is hardened.

* * * * *

UNITED STATES PATENT AND TRADEMARK OFFICE

CERTIFICATE OF CORRECTION

PATENT NO. : 9,090,118 B2
APPLICATION NO. : 14/448668
DATED : July 28, 2015
INVENTOR(S) : Wataru Ikeda It is certified that error appears in the above-identified patent and that said Letters Patent is hereby corrected as shown below:

In the Claims

At Column 16, line 52, in Claim 1, please delete “an ink print”.

Signed and Sealed this
Twenty-ninth Day of December, 2015

Michelle K. Lee

Michelle K. Lee
*Director of the United States Patent and Trademark Office*